US007866445B2

(12) United States Patent
Bukowski et al.

(10) Patent No.: US 7,866,445 B2
(45) Date of Patent: Jan. 11, 2011

(54) LIFT MACHINE

(75) Inventors: Larry Bukowski, Sterling Heights, MI (US); Andrew Griesser, Lake Orion, MI (US); Vincent Sisti, Rochester Hills, MI (US); Detlev Ziesel, Lake Orion, MI (US)

(73) Assignees: GM Global Technology Operations, Inc., Detroit, MI (US); KUKA Systems Corporation North America, Sterling Heights, MI (US)

( * ) Notice: Subject to any disclaimer, the term of this patent is extended or adjusted under 35 U.S.C. 154(b) by 0 days.

(21) Appl. No.: 12/033,123

(22) Filed: Feb. 19, 2008

(65) Prior Publication Data

US 2008/0251325 A1 Oct. 16, 2008

Related U.S. Application Data

(63) Continuation of application No. 11/112,599, filed on Apr. 22, 2005, now Pat. No. 7,331,425.

(60) Provisional application No. 60/586,562, filed on Jul. 9, 2004.

(51) Int. Cl.
*B66B 9/02* (2006.01)
*B66F 7/06* (2006.01)
*B66F 3/22* (2006.01)

(52) U.S. Cl. ..... 187/269; 187/211; 254/122

(58) Field of Classification Search ..... 187/211, 187/269; 254/122
See application file for complete search history.

(56) References Cited

U.S. PATENT DOCUMENTS 355,162 A 12/1886 Grebb
593,806 A 11/1897 Keenan ..... 187/269
1,498,813 A 6/1924 Sankela et al. ..... 187/269
2,734,519 A 2/1956 Widdowson ..... 134/133
3,110,476 A * 11/1963 Farris ..... 254/122
3,341,042 A 9/1967 Carder ..... 214/512
RE26,906 E 5/1970 Barker ..... 214/1
3,623,707 A * 11/1971 Klopp ..... 254/22

(Continued)

FOREIGN PATENT DOCUMENTS

JP 01301480 5/1989

*Primary Examiner*—Evan H Langdon
(74) *Attorney, Agent, or Firm*—Wood, Herron & Evans, LLP

(57) ABSTRACT

A lift machine comprises a base, a support for supporting a load above the base, a lift actuator operatively connected between the base and the support for raising and lowering the support relative to the base, and a support stabilization mechanism operatively connected between the base and the support for stabilizing the support relative to the base during raising and lowering of the support by the lift actuator. The support stabilization mechanism comprises a pair of opposed linkages, with each of the pair of opposed linkages having a lower torque tube link and an upper torque tube link. The lower torque tube link has a torque tube operatively pivoted to the base. The upper torque tube link has a torque tube operatively pivoted to the support. The pair of opposed linkages are interconnected in such a manner that the pair moves in synchronization during raising and lowering of the support by the lift actuator and maintains the support substantially level even in the event that the center of mass of the load is offset from a vertical axis of the lift actuator.

4 Claims, 7 Drawing Sheets

U.S. PATENT DOCUMENTS 4,157,743 A 6/1979 Masuda et al. ..... 182/141
4,405,116 A 9/1983 Eisenberg ..... 254/122
4,723,356 A 2/1988 Sakamoto et al. ..... 29/714
4,875,660 A 10/1989 Gagnon et al. ..... 254/1
4,890,692 A * 1/1990 Oakman ..... 182/141
4,928,386 A 5/1990 Schupp et al. ..... 29/824
5,131,501 A 7/1992 Yoshikawa ..... 187/9
5,145,029 A * 9/1992 Blasdell, Jr. et al. ..... 182/69.5
5,303,655 A 4/1994 Summa et al. ..... 104/140
5,395,209 A 3/1995 Busse et al. ..... 414/799
5,454,625 A * 10/1995 Christensen et al. ..... 298/18
6,109,424 A 8/2000 Doan ..... 198/468.8
6,431,319 B1 8/2002 Myers et al. ..... 187/243
6,547,216 B1 4/2003 Bouchard et al. ..... 254/1
7,331,425 B2 * 2/2008 Bukowski et al. ..... 187/269

* cited by examiner

LIFT MACHINE

RELATED APPLICATION

This application is a continuation of U.S. patent application Ser. No. 11/112,599 filed Apr. 22, 2005, now U.S. Pat. No. 7,331,425 issued on Feb. 19, 2008, which claims priority to U.S. Provisional Patent Application Ser. No. 60/586,562 filed on Jul. 9, 2004, which are hereby incorporated by reference herein as if fully set forth in their entirety.

FIELD OF THE INVENTION

This invention relates generally to lift machines, and more particularly to lift machines for use in the automotive vehicle manufacturing industry for lifting a vehicle chassis into place underneath a suspended vehicle body for subsequent fastening of the chassis to the body.

BACKGROUND OF THE INVENTION

In the automotive vehicle manufacturing industry, it is customary to "marry" the vehicle chassis to the vehicle body on a moving conveyer line. The body is typically conveyed overhead by a conveyor, and the chassis to be married to the body is supported by a moving lift machine that operates to move the chassis into position beneath the moving body while lifting the chassis into position for assembly with the body.

Lift machines may employ different lift actuators to raise and lower the platform or support upon which the vehicle chassis is supported. For example, a hydraulic cylinder can be used as the lift actuator. U.S. Pat. No. 6,109,424, hereby incorporated by reference herein, discloses the use of a push chain as the lift actuator. And, U.S. Patent Application Publication No. US 2004/0007440 A1, also hereby incorporated by reference herein, discloses the use of a spiral lift as the lift actuator.

It is desirable to provide a lift machine which is as compact and as inexpensive as possible. Employing a single lift actuator for the lift machine aids in keeping the lift machine compact and reduces the cost of the machine. However, stability of the chassis supporting platform becomes an issue when only a single lift actuator is employed. For example, in the event that the center of mass of the chassis is offset from the vertical axis of the lift actuator, a moment load is applied to the platform upon which the chassis is supported. That moment load can cause tilting of the platform and hence tilting of the chassis. Such tilting can hinder the assembly operation. It is thus desirable to provide a lift machine which employs a single lift actuator in order that the lift machine be as compact and inexpensive as possible, yet which is also stable under load.

SUMMARY OF THE INVENTION

The present invention is a lift machine comprising a base, a support for supporting a load above the base, a lift actuator operatively connected between the base and the support for raising and lowering the support relative to the base, and a support stabilization mechanism operatively connected between the base and the support for stabilizing the support relative to the base during raising and lowering of the support by the lift actuator. The support stabilization mechanism comprises a pair of opposed linkages, each of the pair of opposed linkages having a lower torque tube link and an upper torque tube link. The lower torque tube link has a torque tube operatively pivoted to the base, and the upper torque tube link has a torque tube operatively pivoted to the support. The pair of opposed linkages are interconnected in such a manner that the pair moves in synchronization during raising and lowering of the support by the lift actuator and maintains the support substantially level even in the event that the center of mass of the load is offset from a vertical axis of the lift actuator.

Each of the lower and upper torque tube links can have a pair of link arms. The link arms of the lower torque tube links are operatively pivoted to the link arms of the upper torque tube links.

Each of the pair of opposed linkages can further include a lower link and an upper link. The upper link has a first end operatively pivoted to the one of the pair of link arms of the upper torque tube link and a second end operatively pivoted to a first end of the lower link. The lower link has a second end cooperating with the base in such a manner as to permit translation of the second end of the lower link relative to the base during raising and lowering of the support by the lift actuator. For example, the second end of the lower link can have a roller thereon which operatively rolls along the base.

The stabilization mechanism can further include a connecting link for interconnecting the pair of opposed linkages. The connecting link has first and second ends, with the first end of the connecting link operatively pivoted to the second end of the upper link of one of the pair of opposed linkages and to the first end of the lower link of the one pair of opposed linkages. The second end of the connecting link is operatively pivoted to the second end of the upper link of the other pair of opposed linkages and to the first end of the lower link of the other pair of opposed linkages. The link arms of the lower and upper torque tube links cooperate with the connecting link in such a manner as to permit translation of the link arms relative to the connecting link during raising and lowering of the support by the lift actuator. For example, the link arms can each have a roller thereon which operatively rolls along the connecting link. To that end, the connecting link can include a lateral recess therein in which the roller rolls.

The lift actuator can be any suitable lift actuator, such as a hydraulic cylinder, a push chain, a spiral lift, etc.

The invention is also apparatus for lifting and supporting an automotive chassis in position to be assembled with an automotive body along a moving assembly line. The apparatus comprises a mobile vehicle, and one or more of the lift machines described above carried by the mobile vehicle.

These and other features and advantages of the present invention will become more readily apparent during the following detailed description taken in conjunction with the drawings herein, in which:

DETAILED DESCRIPTION OF THE INVENTION

Figure 1:
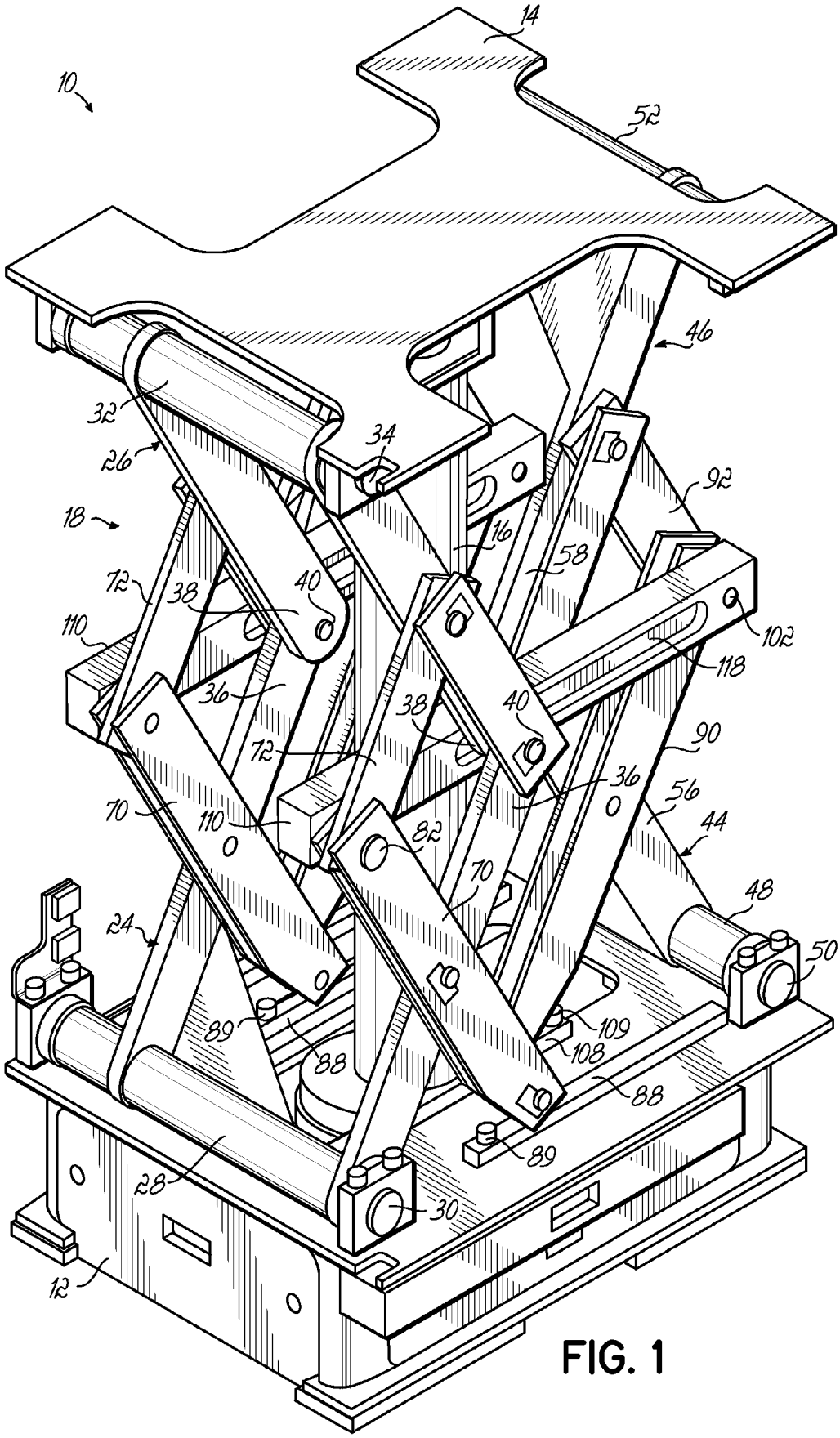
FIG. 1 is a perspective view of the lift machine of the present invention.

Referring to FIGS. 1-4, there is illustrated a lift machine 10 according to the present invention. The lift machine 10 has a base 12, a support or platform 14 for supporting a load above the base 12, a lift actuator 16 operatively connected between the base 12 and the support 14 for raising and lowering the support 14 relative to the base 12, and a support stabilization mechanism 18 operatively connected between the base 12 and the support 14 for stabilizing the support 14 relative to the base 12 during raising and lowering of the support 14 by the lift actuator 16. Lift actuator 16 can be any suitable lift actuator, for example hydraulic cylinder, push chain (FIG. 3A, 16*a*), spiral lift (FIG. 3B, 16*b*), air bladder, crank arm, bell crank mechanism, rack and pinion, double rack and pinion, ball screw, telescoping ball screw, roller screw, acme screw, 60° threaded screw, linear or rotary cam, screw jack, electric cylinder, rodless actuator, belt, gear motor actuated linkage, pneumatic cylinder, chain, etc.

The support stabilization mechanism 18 can comprise a pair of opposed linkage mechanisms 20, 22. Linkage mechanism 20 has a lower torque tube link 24 and an upper torque tube link 26. The lower torque tube link 24 has a torque tube 28 operatively pivoted to the base 12 via axle 30. The upper torque tube link 26 has a torque tube 32 operatively pivoted to the support 14 via axle 34. The lower and upper torque tubes 28, 32 each have a pair of link arms 36, 36 and 38, 38, respectively, rigidly affixed to the ends of their respective torque tubes 28, 32. The ends of the link arms 36, 36 and 38, 38 are operatively pivoted together via pivot pins 40.

Similarly, linkage mechanism 22 has a lower torque tube link 44 and an upper torque tube link 46. The lower torque tube link 44 has a torque tube 48 operatively pivoted to the base 12 via axle 50. The upper torque tube link 46 has a torque tube 52 operatively pivoted to the support 14 via axle 54. The lower and upper torque tubes 48, 52, each have a pair of link arms 56, 56 and 58, 58, respectively, rigidly affixed to the ends of their respective torque tubes 48, 52. The ends of the link arms 56, 56 and 58, 58 are operatively pivoted together via pins 60.

Linkage 20 can further include a pair of lower links 70 and a pair of upper links 72. Each upper link 72 has a first end 74 operatively pivoted to one of the link arms 38 of upper torque tube link 26 via pin 76, and a second end 78 operatively pivoted to a first end 80 of one of the lower links 70 via pin 82. Each lower link 70 has a second end 84 which cooperates with the base 12 in such a manner so as to permit translation of the second end 84 relative to the base 12 during raising and lowering of the support 14 by the lift actuator 16. For example, the second ends 84 of lower links 70 can each have a roller 86 which operatively rolls along the base 12. Each roller 86 can roll on rail 88 on base 12. A stop 89 on the end of each rail 88 limits travel of roller 86 and hence upward movement of support 14.

Similarly, linkage 22 can further include a pair of lower links 90 and a pair of upper links 92. Each upper link 92 has a first end 94 operatively pivoted to one of the link arms 58 of upper torque tube link 46 via pin 96, and a second end 98 operatively pivoted to a first end 100 of one of the lower links 90 via pin 102. Each lower link 90 has a second end 104 which cooperates with the base 12 in such a manner so as to permit translation of the second end 104 relative to the base 12 during raising and lowering of the support 14 by the lift actuator 16. For example, the second ends 104 of lower links 90 can each have a roller 106 which operatively rolls along the base 12. Each roller 106 can roll on rail 108 on base 12. A stop 109 on the end of each rail 108 limits travel of roller 106 and hence upward movement of support 14.

The stabilization mechanism 18 can further include a pair of connecting links 110 for interconnecting the pair of opposed linkages 20, 22. Each connecting link 110 has first and second ends 112, 114, respectively. The first end 112 is operatively pivoted to the second end 78 of one of the upper links 72 of linkage 20 via pin 82, and the second end 114 is operatively pivoted to the second end 98 of one of the upper links 92 of the linkage 22 via pin 102. The link arms 36, 36, 56, 56, 38, 38, and 58, 58 of the lower and upper torque tube links 24, 44 and 26, 46, respectively, cooperate with the connecting links 110 in such a manner as to permit translation of the ends of the link arms 36, 36, 56, 56, 38, 38, and 58, 58 relative to the connecting links 110 during raising and lowering of the support 14 by the lift actuator 16. For example, the ends of link arms 36, 36, 56, 56, 38, 38, and 58, 58 can have rollers 116 which operatively roll along connecting links 110, for example within lateral recesses 118 thereof.

Figure 5:
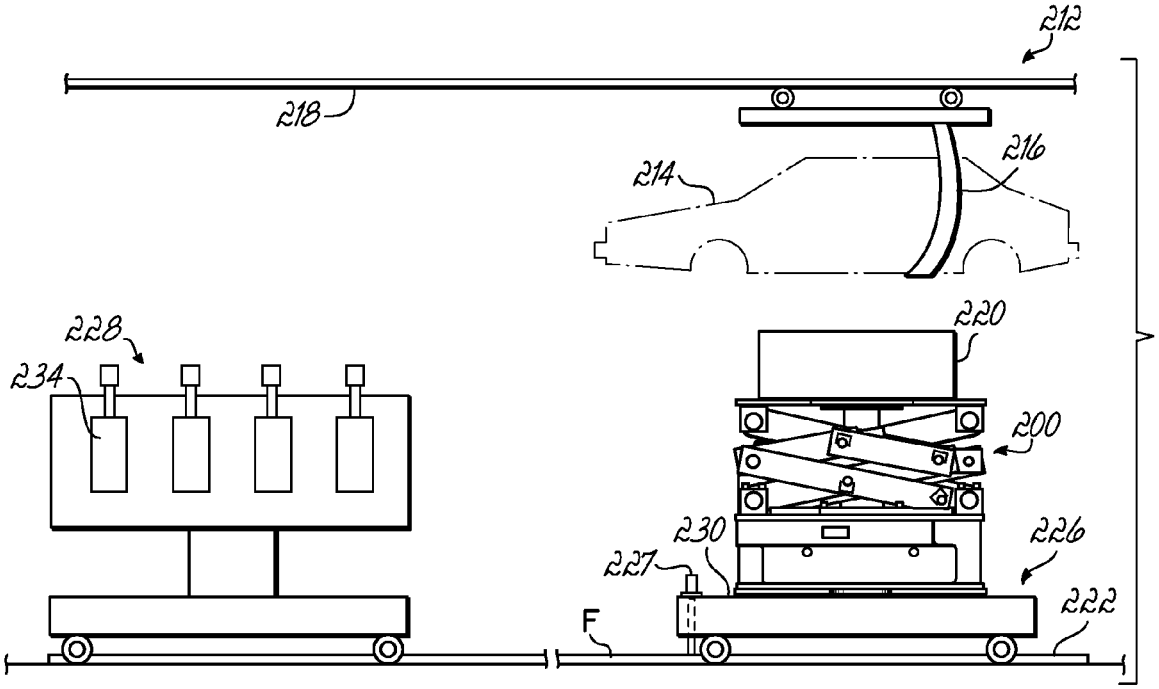
FIG. 5 is a side view illustrating use of the lift machine of FIG. 1 in one possible application, namely to marry a vehicle chassis to a vehicle body on a continuously moving conveyor line.

Referring now to FIG. 5, the lift machine of the present invention is shown in one illustrative application as an automotive vehicle chassis/body marriage lift machine (or chassis lift vehicle or apparatus) designated generally at 200 and shown as it would be used at a chassis/body marriage and assembly station 212 of an automotive production line. Automotive vehicle bodies, such as that shown at 214, are brought into station 212 one at a time by an overhead clamshell conveyor 216 that is supported by and moves around an endless overhead rail 218. Automotive chassis modules 220 are also brought into station 212 via an overhead conveyor 224 (FIG. 6) and then are placed onto lift machine 10 for subsequent assembly into vehicle body 214.

To provide a continuously operating production line, the lifting and assembly of the chassis module 220 into vehicle body 214 is carried out while the vehicle body 214 moves along the clamshell conveyor 216. Thus the lift machine 10 runs along a floor track 222 (or is self-guided) underneath the conveyor 216 while chassis module 220 is lifted and fastened into the vehicle body 214. Movement of lift machine 10 along track 222 and the required synchronization of lift machine 10 with conveyor 216 are well known to those skilled in the art and will therefore not be elaborated upon.

The machine 10 is carried by a wheeled vehicle 226 that serves as the base or framework of the machine 10 on which other components of the machine are supported. There are generally three types or classes of vehicles 26 that may be utilized in conjunction with the lift mechanism of the invention. They include those that are self-propelled but guided by a floor track such as that shown at 222, a so-called tow-veyor type vehicle (not shown) which is towed by a floor cable or the like along a floor track 222, or a self-powered, self-guided type vehicle, known generally as an automatic guided vehicle or AGV (not shown), which is self-propelled and programmable to be self-guided without the assistance of a floor track along a preset path. Of course, other vehicle types could be used and are contemplated as equivalent provided they are suitable for the intended purpose of marrying chassis components to automotive bodies.

Figure 6:
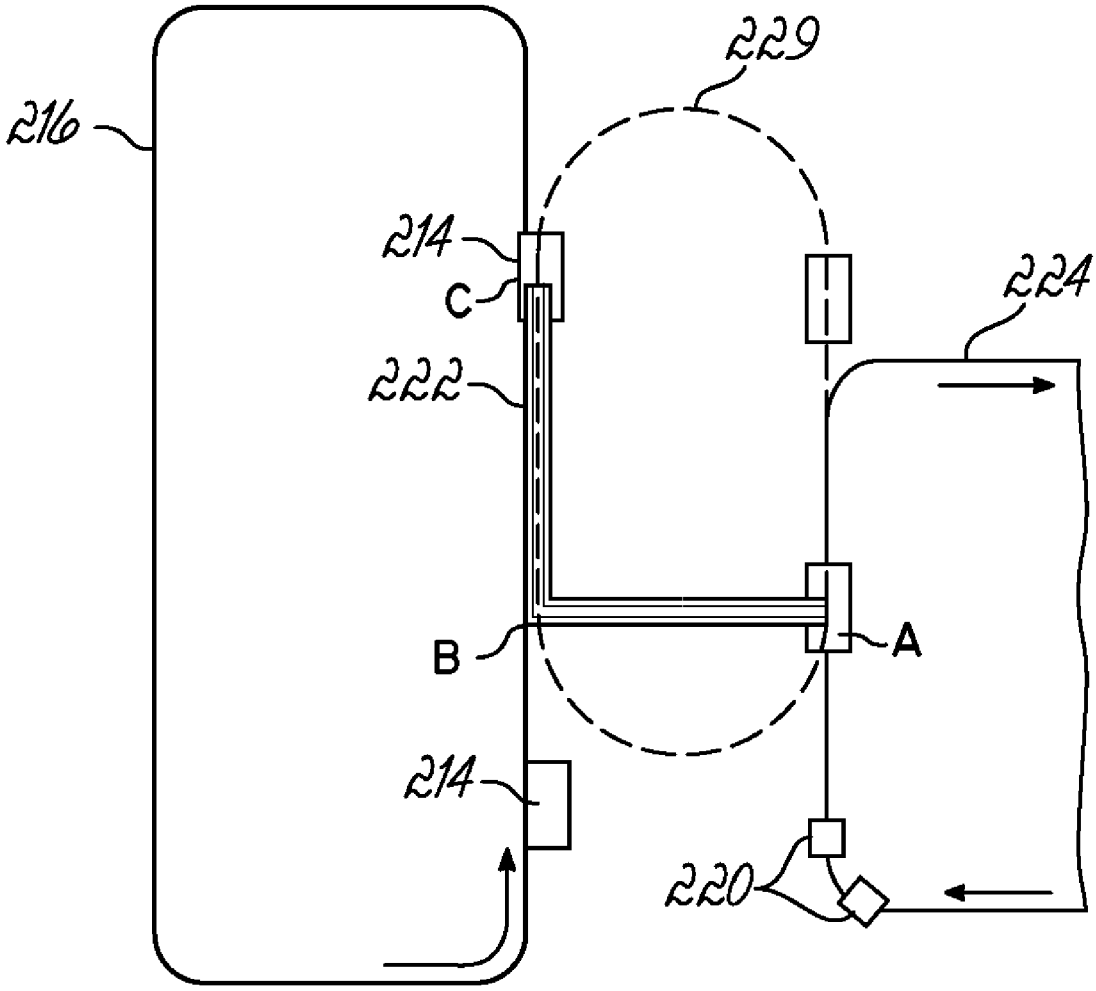
FIG. 6 is a top view of the apparatus of FIG. 5.

FIG. 5 illustrates a self-powered vehicle 226 having an on-board drive motor 227 that drives the vehicle 226 along the guide track 222 in conventional manner. Referring to FIG. 6, the track 222 can be an L-track defined by points A, B, C. When at point A, lift machine 10 is in position to receive and support a chassis module 220 from overhead conveyor 224. As will be appreciated, the lateral offset between points A and B is selected to prevent any interference between the vehicle body overhead conveyor 216 and the chassis module overhead conveyor 224.

Once lift machine 10 has received a chassis module at point A, lift machine 10 moves to point B where is comes into alignment with a vehicle body 214 from overhead conveyor 216. Lift machine 10 then moves synchronously with vehicle body 214 between points B and C while the chassis module 220 is lifted and fastened into the vehicle body. Thereafter, lift machine 10 returns to point A to repeat the cycle.

The fastening of chassis module 220 to vehicle body 214 can be carried out either manually or automatically. In the illustrated embodiment shown in FIG. 5, fastening is carried out automatically and in a conventional manner using a mobile screw station 228 that reciprocates between points B and C on track 222. Screw station 228 moves synchronously with lift machine 10 and vehicle body 214 from point B to point C, during which time chassis module 220 is secured to vehicle body 214 using fasteners (not shown).

Automatic fastening is accomplished using a pallet 230 that is attached to lift machine 10 and that is used to hold and properly locate chassis module 220 for assembly into vehicle body 214. Pallet 230 can be used to hold each of the required fasteners 232 at the proper location in preparation for fastening of the chassis module to the vehicle body. Pallet 230 also includes nut drivers (not shown) for each of the fasteners. Screw station 228 includes motorized drives 234, each of which mates with a corresponding nut driver in pallet 230 to provide automated tightening of the fasteners. As screw station 228 moves along track 222 with lift machine 10, it extends its motorized drives 234 upwards until they engage their associated nut drivers. The fasteners can then be automatically tightened into vehicle body 214.

Figure 2:
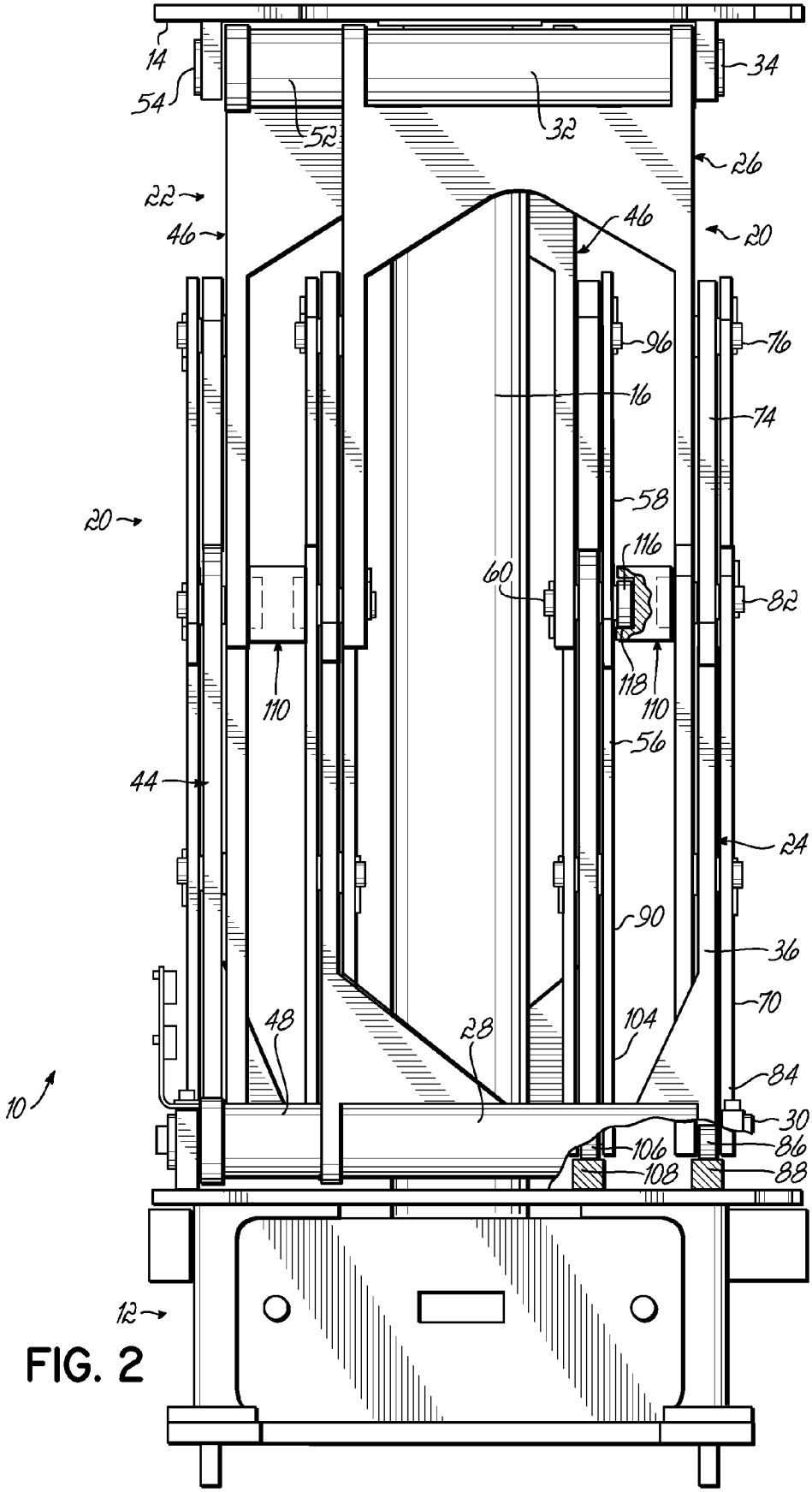
FIG. 2 is an end view of the apparatus of FIG. 1.
Figure 3:
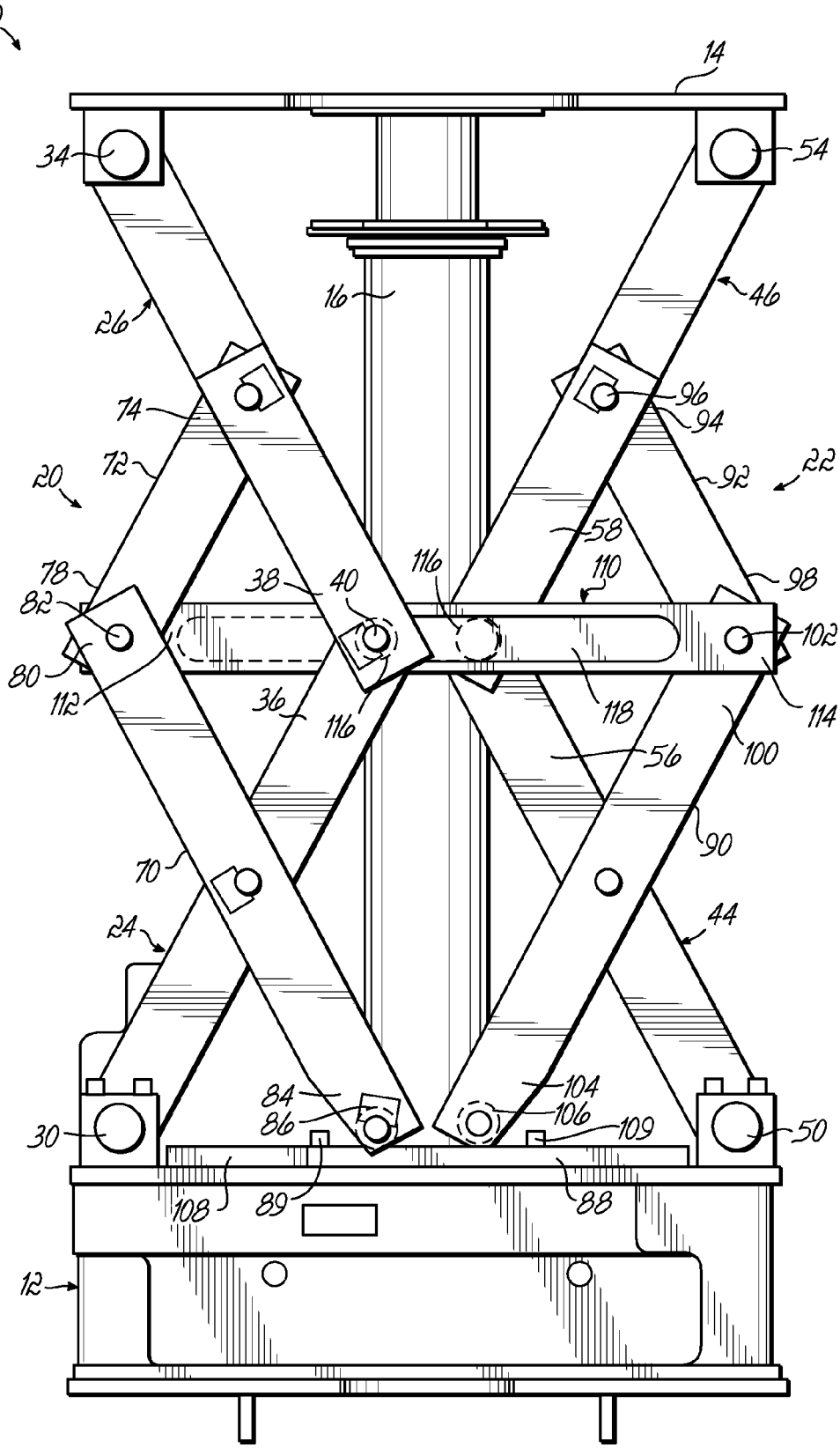
FIG. 3 is a side view of the apparatus of FIG. 1.
Figure 3A:
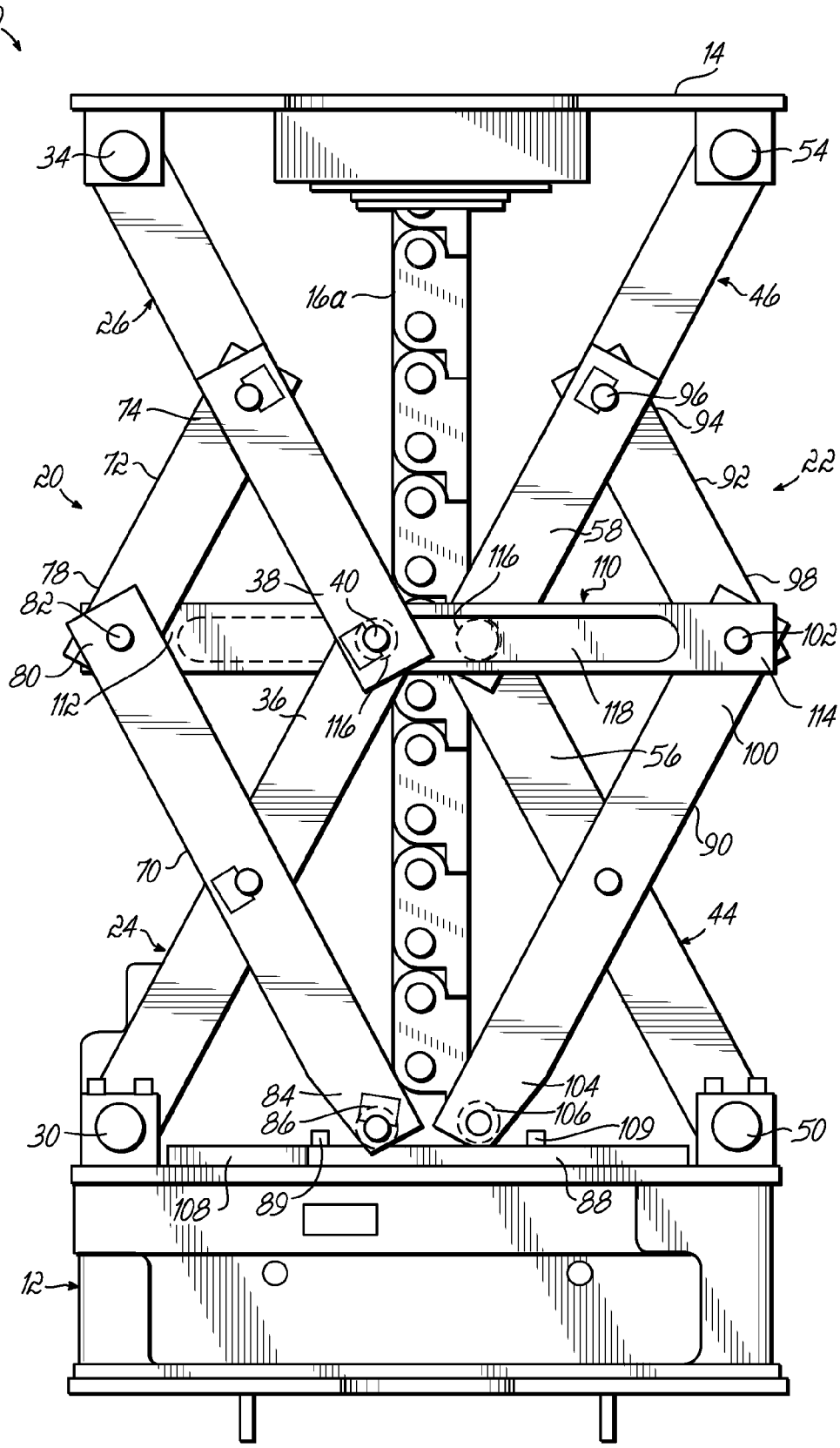
FIG. 3A is a side view of an alternative apparatus.
Figure 3B:
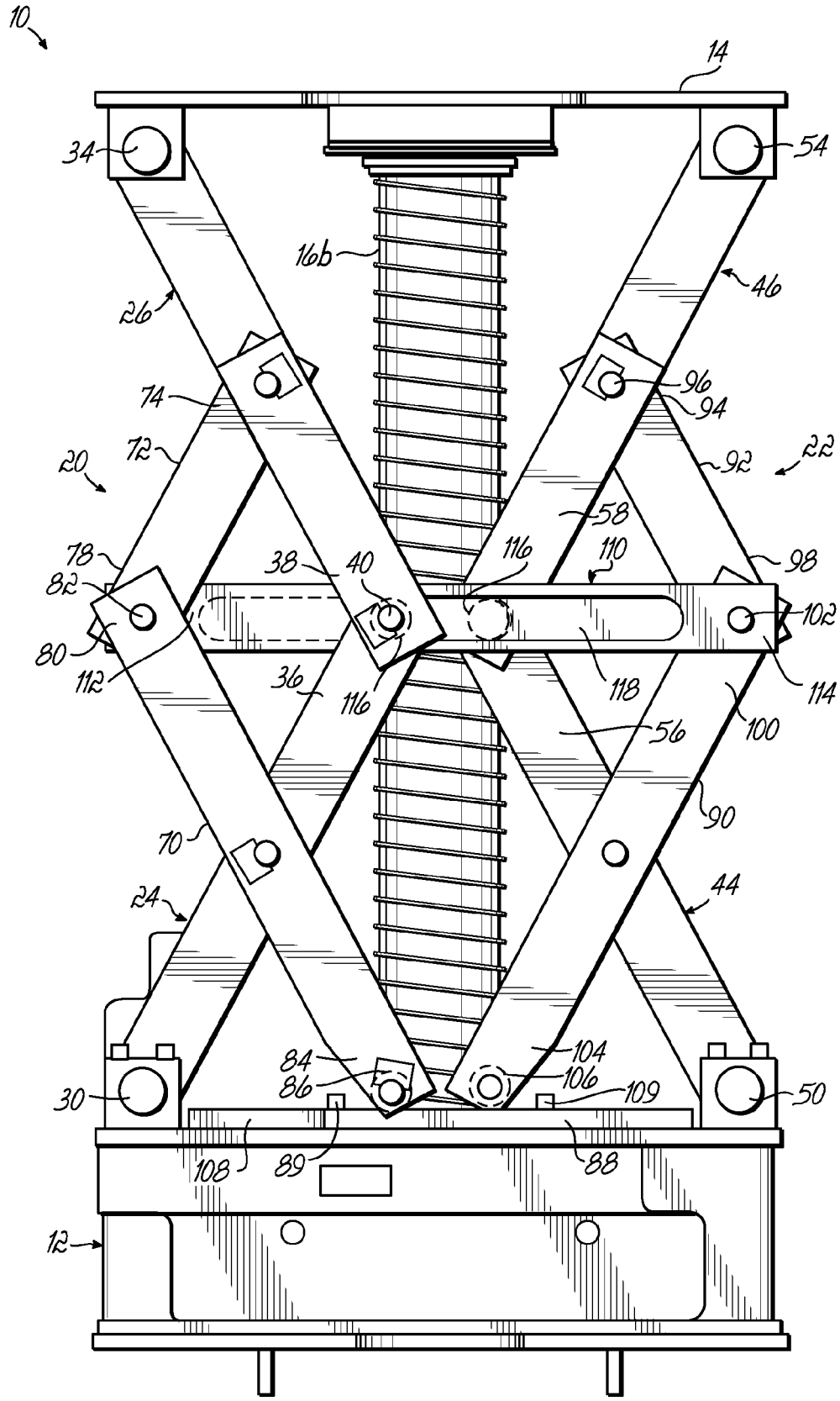
FIG. 3B is a side view of yet another alternative apparatus.
Figure 4:
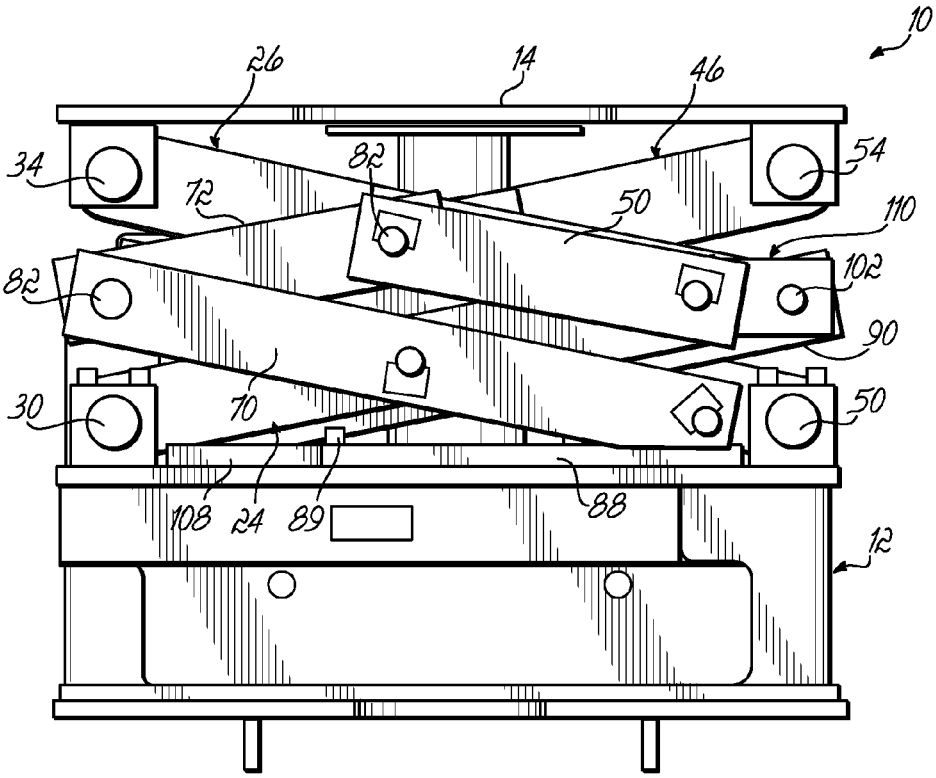
FIG. 4 is a view similar to FIG. 3 but illustrating the lift machine collapsed.

The lift machine of the present invention provides a compact, stable device for lifting a load. The interconnection of the torque tube linkages in such a manner that the pair of linkages move in synchronization during raising and lowering of the support by the lift actuator maintains the support substantially level, even in the event that the center of mass of the load is offset from the vertical axis of the lift actuator. The lift machine of the present invention is able to meet a maximum deflection specification of only 0.25 inch at a corner of the support when a 4000 pound load is applied 18 inches off-center "fore and aft" (left or right of the vertical center line of the lift actuator as seen in FIG. 3) and 4 inches off-center "cross car" (left or right of the vertical center line of the lift actuator as seen in FIG. 2). In addition, the lift machine of the present invention has great torsional stiffness about a vertical axis, and thus is resistant to lateral horizontal loads applied to the corners of the support. Furthermore, the lift machine of the present invention provides a vertical "stroke" of 38 inches with an overall machine width of only 39 inches (width being the lateral dimension of the machine when viewing the machine from the side, as in FIG. 3). The lift machine of the present invention has a 27 inch collapsed height (FIG. 4), and, thus, with a stroke of 38 inches, has a 65 inch extended height.

Those skilled in the art will readily recognize numerous adaptations and modifications which can be made to the present invention which will result in an improved lift machine, yet all of which will fall within the spirit and scope of the present invention as defined in the following claims. Accordingly, the invention is to be limited only by the scope of the following claims and their equivalents.

What is claimed is:

1. A lift machine comprising:

a base having a longitudinal axis and a transverse axis, a support for supporting a load above said base, a lift actuator operatively connected between said base and said support for raising and lowering said support relative to said base, and a support stabilization mechanism operatively connected between said base and said support for stabilizing said support relative to said base during raising and lowering of said support by said lift actuator, said support stabilization mechanism comprising a pair of opposed linkages spaced apart along the longitudinal axis of said base, each of said pair of opposed linkages having a pair of lower torque tube link arms and a pair of upper torque tube link arms, said lower torque tube link arms having a lower torque tube rigidly connected therebetween and operatively pivoted to said base at a fixed location, said upper torque tube link arms having an upper torque tube rigidly connected therebetween and operatively pivoted to said support at a fixed location, said torque tubes extending in a direction generally parallel to the transverse axis of said base, said lower torque tube capable of transmitting torque from one of said pair of lower torque tube link arms to the other of said pair of lower torque tube link arms, said upper torque tube capable of transmitting torque from one of said pair of upper torque tube link arms to the other of said pair of upper torque tube link arms, said pair of opposed linkages being interconnected in such a manner that said pair moves in synchronization during raising and lowering of said support by said lift actuator and maintains said support substantially level even in the event that a center of mass of the load is offset from a vertical axis of said lift actuator.

2. The lift machine of claim 1 wherein said pair of lower torque tube link arms are operatively pivoted to said pair of upper torque tube link arms for each linkage of said pair of opposed linkages.

3. Apparatus for lifting and supporting an automotive chassis in position to be assembled with an automotive body along a moving assembly line, said apparatus comprising:

a mobile vehicle, and a lift machine carried by said mobile vehicle, said lift machine comprising:

a base having a longitudinal axis and a transverse axis, a support for supporting a load above said base, a lift actuator operatively connected between said base and said support for raising and lowering said support relative to said base, and a support stabilization mechanism operatively connected between said base and said support for stabilizing said support relative to said base during raising and lowering of said support by said lift actuator, said support stabilization mechanism comprising a pair of opposed linkages spaced apart along the longitudinal axis of said base, each of said pair of opposed linkages having a pair of lower torque tube link arms and a pair of upper torque tube link arms, said lower torque tube link arms having a lower torque tube rigidly connected therebetween and operatively pivoted to said base at a fixed location, said upper torque tube link arms having an upper torque tube rigidly connected therebetween and operatively pivoted to said support at a fixed location, said torque tubes extending in a direction generally parallel to the transverse axis of said base, said lower torque tube capable of transmitting torque from one of said pair of lower torque tube link arms to the other of said pair of lower torque tube link arms, said upper torque tube capable of transmitting torque from one of said pair of upper torque tube link arms to the other of said pair of upper torque tube link arms, said pair of opposed linkages being interconnected in such a manner that said pair moves in synchronization during raising and lowering of said support by said lift actuator and maintains said support substantially level even in the event that a center of mass of the load is offset from a vertical axis of said lift actuator.

4. The apparatus of claim 3 wherein said pair of lower torque tube link arms are operatively pivoted to said pair of upper torque tube link arms for each linkage of said pair of opposed linkages.

* * * * *